US005794336A

United States Patent [19]

Hopson et al.

[11] Patent Number: 5,794,336

[45] Date of Patent: Aug. 18, 1998

[54] ELECTRICAL CONNECTOR HAVING IMPROVED CONTACT RETENTION MEANS

[75] Inventors: Mark G. Hopson, Greer, S.C.; Scott C. Roland, Collesville, Tenn.

[73] Assignee: Thomas & Betts Corporation, Memphis, Tenn.

[21] Appl. No.: 794,159

[22] Filed: Feb. 3, 1997

Related U.S. Application Data

[63] Continuation of Ser. No. 413,662, Mar. 30, 1995.

[51] Int. Cl.[6] ..... H01R 43/04

[52] U.S. Cl. ..... 29/882; 439/736; 439/79

[58] Field of Search ..... 439/736, 79, 80, 439/739, 942; 29/882, 883, 884; 156/73.1

[56] References Cited

U.S. PATENT DOCUMENTS

| | | | |
|---|---|---|---|
| 3,440,117 | 4/1969 | Soloff et al. | 156/73 |
| 3,440,118 | 4/1969 | Obeda | 156/73 |
| 3,493,916 | 2/1970 | Hansen | 339/17 |
| 3,862,791 | 1/1975 | Miller . | |
| 3,959,430 | 5/1976 | Takamatsu | 264/157 |
| 4,491,376 | 1/1985 | Gladd et al. | 339/9 |
| 4,697,340 | 10/1987 | Finney et al. | 29/862 |
| 4,734,043 | 3/1988 | Emert et al. | 439/736 X |
| 4,789,346 | 12/1988 | Frantz | 439/80 |
| 4,842,528 | 6/1989 | Frantz | 439/80 |
| 4,860,445 | 8/1989 | Jones | 439/736 X |
| 4,986,772 | 1/1991 | Fukutani | 439/79 X |
| 5,037,334 | 8/1991 | Viselli et al. | 439/733 |
| 5,046,243 | 9/1991 | Walker . | |
| 5,112,233 | 5/1992 | Lybrand | 439/79 |
| 5,169,347 | 12/1992 | Sang | 439/885 |
| 5,387,137 | 2/1995 | Bouwknegt et al. | 439/736 |
| 5,433,624 | 7/1995 | Tabata | 439/79 X |

FOREIGN PATENT DOCUMENTS 0 233 742 8/1987 European Pat. Off. .

OTHER PUBLICATIONS

Photograph of an electrical connector which is described at p. 2, line 30, p. 3, line 9 of the Specification.

*Primary Examiner*—Gary F. Paumen
*Assistant Examiner*—Katrina Davis
*Attorney, Agent, or Firm*—Hoffmann & Baron, LLP

[57] ABSTRACT

An electrical connector housing includes a deformable contact retention plate for accommodating the tails of electrical contacts. Contact tails are supported within slots in the retention plate both at a closed end of the slot as well as at an intermediate location therealong. The contact retention plate may be deformed about the contacts so as to captively retain the contact tails within the slots. Such deformation may be achieved by ultrasonically swaging the plastic forming the contact retention plate about the contact tails.

12 Claims, 4 Drawing Sheets

ELECTRICAL CONNECTOR HAVING IMPROVED CONTACT RETENTION MEANS

"This application is a continuation copending application Ser. No. 08/413,662, filed on Mar. 30, 1995."

FIELD OF THE INVENTION

The present invention relates generally to an electrical connector. More particularly, the present invention relates to an improved contact alignment and retention system for right-angle electrical connectors.

BACKGROUND OF THE INVENTION

Right angle, D-faced electrical connectors are used in the electronics industry as input/output (I/O) devices to interconnect a computer to external peripheral equipment. The connector includes an insulative housing which accommodates conductive electrical contacts. The contacts of the electrical connector are typically soldered to conductive traces on a printed circuit board at a backwall or panel of the computer. The front face of the connector, in addition to having the D-face for polarization, is mated with a complementary electrical connector which is attached to the peripheral equipment. The electrical contacts are supported in apertures in the insulative housing of the connector with the back ends of the contacts bent at right angles. Each contact includes contact tails in the form of solder posts which extend downward from the connector housing for insertion into plated through holes in a printed circuit board (PCB) for subsequent soldering thereto. Maintaining the position and alignment of the projecting solder posts for ease of insertion into pre-formed plated through holes in a PCB has been recognized as a desirable feature of these connectors.

Various approaches have been developed to maintain the contact solder posts in a pre-determined, aligned position. For example, one commonly known technique is to form the connector housing to have a slotted locator or retention plate wherein the slots are formed as straight parallel-walled channels which receive U-shaped, resilient retention portions of the contacts in frictional engagement. U.S. Pat. No. 3,493,916 (Hansen) exemplifies this technique.

U.S. Pat. No. 4,491,376 (Glad, et al) illustrates another approach where the slots in the connector locator plate are formed to be narrower than the solder posts and which slots are configured to have recesses providing detents to retain the solder posts therein. Other slotted locator plate techniques as shown in U.S. Pat. No,. 4,789,346 (Franz) and U.S. Pat. No. 4,842,528 (Franz) wherein the locator plate slots are particularly configured to provide deflectable beams therebetween, the particularly configured slots receiving U-shaped portions of the contact therein.

An improved technique for retaining contact tails within a locator plate is shown in commonly assigned U.S. Pat. No. 5,112,233 (Lybrant) which is incorporated by reference herein. The contact tails shown in the '233 patent are configured to have a retention portion including barbs which extend for frictional engagement with the walls of the slot of the locator plate upon insertion to retain the contact tail within the locator plate.

While the technique described in the '233 patent is quite suitable for its purposes, it would be further desirable to provide the ability to insert the contact within the locator plate without substantially engaging with the walls of the slots in order to simplify installation of the contacts into the housing.

Another known technique is to provide a locator plate with elongate slots configured to non-frictionally accommodate the solder posts therein. The solder posts may be freely inserted into the slot through the open end thereof. Each post would be inserted until it bottoms against the opposed closed end of the slot. A securement device such as a supported ultrasonic horn could then be used to deform the slot to secure the solder posts against the closed end of the slots. While this technique serves adequately to secure the solder post against the closed end of the slot, no technique has been developed to support and secure the solder post at an intermediate location along the slot.

SUMKMAY OF THE INVENTION

It is an object of the present invention to provide an improved electrical connector for retaining contacts in a connector housing.

It is a further object of the present invention to provide an improved contact retention structure which accommodates and retains contact tails therein.

It is a still further object of the present invention to provide a method for retentively containing the tails of an electrical contact in a connector housing.

In the efficient attainment of these and other objects, the present invention provides an electrical connector including an insulative electrical housing having a deformable contact retention plate which defines an elongate contact accommodating slot therethrough. An electrical contact is supported by the housing and includes a retention extent which is resident within the slot at an intermediate location. The contact retention plate includes a deformed portion thereof which substantially surrounds the retention extent of the contact to captively retain the retention extent within the intermediate location of the slot. As more particularly described by way of the preferred embodiment herein, the contact retention plate may be deformed by applying an ultrasonic force to the retention plate to deform a portion of the retention plate about the contact.

In a method aspect of the present invention, a method is provided for retentively supporting an electrical contact and electrical connector. A connector housing is provided having a contact retention plate defining an elongate contact accommodation slot therein. The slot includes an opened, a closed end and an intermediate slot portion therebetween. An electrical contact having a contact retention extent is also provided. A contact is inserted into the connector housing so that the retention extent thereof is non-captively resident within the intermediate slot portion. The retention plate is then deformed about the retention extent of the contact to captively confine the retention extent of the contact within the intermediate slot portion. The deformation of the retention plate may take place by ultrasonic swaging of the retention plate around the retention extent of the contact.

DETAILED DESCRIPTION OF THE PREFERRED EMBODIMENT

Figure 1:
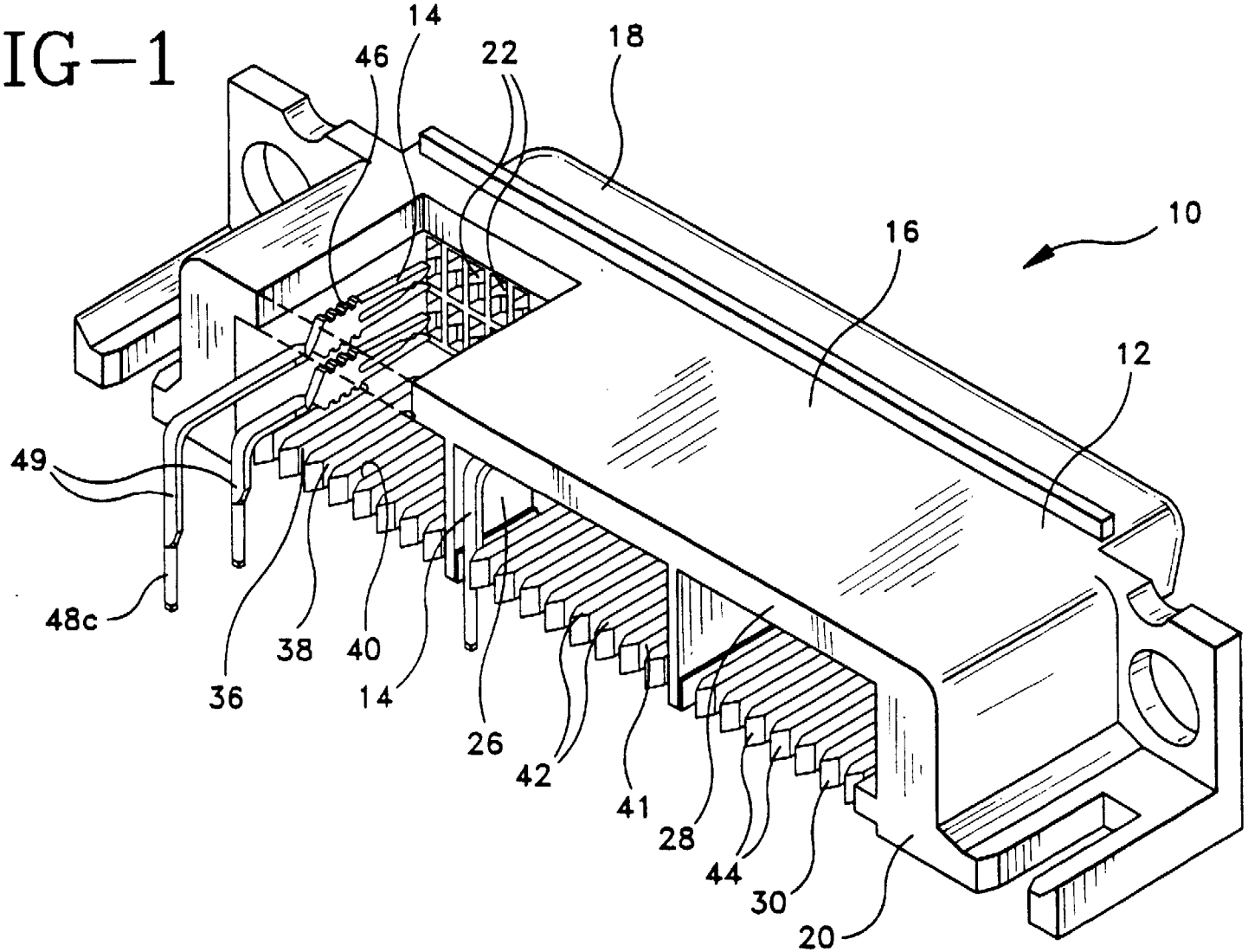
FIG. 1 is a rear perspective view of an electrical connector in accordance with a preferred embodiment of the present invention partially broken away to reveal two contacts removed from the connector.

Referring to FIG. 1, there is shown a right-angle D-subminiature electrical connector 10. Connector 10 includes an insulative housing 12 and a plurality of right-angle electrical contacts 14 supported within the housing. As is well known in the electrical connector art, connector 10 may include an outer conductive shell (not shown) positioned therearound to shield the connector from electromagnetic or radio frequency interferences (EMI/RFI). Connector 10 shown in FIG. 1 is designed for attachment to a printed circuit board (not shown).

Housing 12 is formed of a suitably insulative plastic material and includes a generally elongate body 16 having a front face 18 and a rear face 20. Front face 18 may be formed into a conventional D-configuration for polarized connection with a complementary connector. Front face 18 includes a plurality of apertures 22 which, as will be described in further detail hereinbelow, permit accommodation of electrical contacts 14 in connector housing 12. Housing 12 further includes opposed top and bottom walls 28 and 30, which define therebetween a cavity 26 which is in communication with apertures 22 and serve to accommodate electrical contacts 14. Bottom wall 30 further serves as a locator or retention plate for positionally confining contacts 14 therein.

Figure 2:
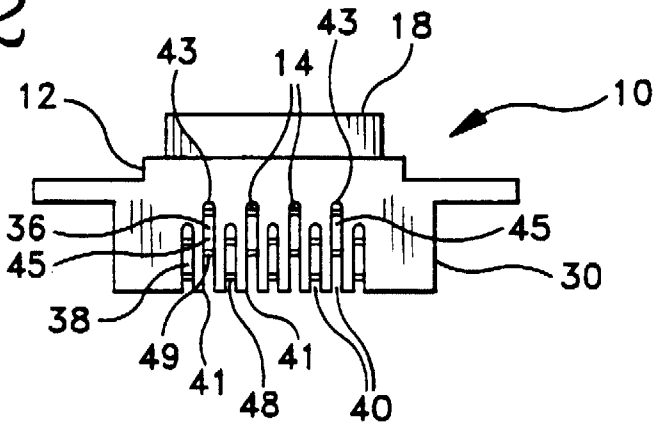
FIG. 2 is a bottom plan view of an embodiment of the connector of the present invention showing the contact retention plate.
Figure 4:
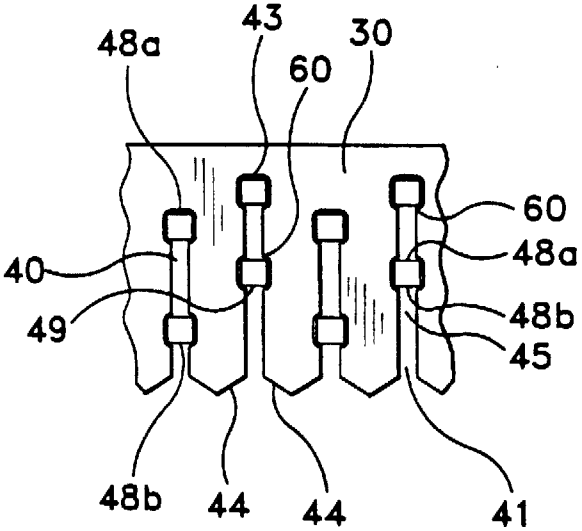
FIG. 3 and 4 show respectively, a portion of the retention plate of FIG. 2, both before and after swaging about the electrical contacts position therein.
Figure 3:
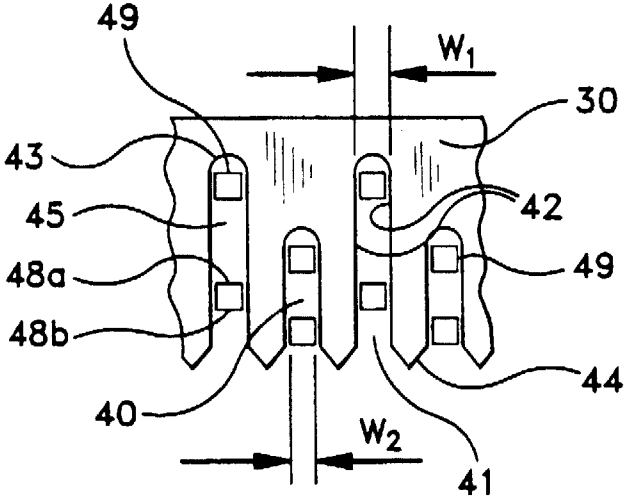

As is shown in FIGS. 2–4, bottom wall 30 includes a plurality of longitudinally extending slots 40 each having an open end 41 at the rear face 20 of housing 12 and a closed end 43 opposite thereto. An intermediate slot portion 45 is defined between open end 41 and closed end 43. Slots 40 extend through bottom wall 30 and are in communication with cavity 26 between top wall 28 and bottom wall 30. Slots 40 have generally two configurations. Longer slots 36 alternate in transversely spaced relation with shorter slots 38. Each slot 40 is defined by a pair of opposed longitudinal generally parallel side walls 42. Each side wall has a tapered surface 44 at the distal end thereof. Adjacent tapered surfaces 44 define the wider slot open end 41 opening at the rear face 20 of housing 12. Such wider opening facilitates insertion of the contacts thereinto.

Connector housing 12 supports a plurality of electrical contacts 14. Each contact 14 is an elongate member having an interconnection end 46 which is shown in FIG. 1, preferably formed into a socket configuration and an opposed contact tail 48 at the opposite end thereof. Contact tail 48 is also referred to as a solder post as the tail is designed to be inserted into a plated through hole (not shown) of a printed circuit board where it may be soldered thereto to establish electrical connection. In preferred form, contact tail 48 has a generally rectangular uniform cross-sectional extent 49 except for a narrower tapered distal end **48*c* which facilitates insertion of the contact tail into the plated through hole. The rectangular configuration of extent 49 of contact tail 48 defines a pair of opposed contact surfaces 48*a* and 48*b*. The particular construction of contact 14** may be of the type shown and described in the above-incorporated U.S. Pat. No. 5,112,233.

As shown in FIGS. 1 and 3, contacts 14 are loaded or inserted into connector housing 12 by inserting interconnection portion 46 of contact 14 into apertures 22. Upon insertion of interconnection portion 46 into housing 12 contact tails 48 are inserted into slots 40 of bottom wall 30. Forward opposed surface **48*a* faces closed end 43 while opposed surface 48*b* faces open end 41. The construction of the electrical connector 10 of the present invention is substantially shown and described in the above referenced '233 patent which is incorporated herein by reference. As the electrical connector 10** of the present invention is designed to be secured to a printed circuit board by soldering the contact tails to the plated through holes thereof, in order to provide for securement of the connector to the printed circuit board, it is desirable to retentively secure the contact tails in the connector housing.

Referring to FIGS. 2 through 4, the technique to secure the contact tails 48 in connector housing 12 of the present invention is shown. With specific reference to Fig. 3, construction of the slots of the present invention may be shown. As mentioned above, slots 40 are defined by opposed slot side walls 42, which are generally linear and parallel to one another. Opposed side walls 42 are constructed to define a slot width of a given dimension $W_1$. Contact extent 49 has a generally transverse expanse of $W_2$, which is less than the transverse expanse $W_1$ of slot 40. Thus, as is graphically shown in FIG. 3, upon insertion of contacts 14 in connector housing 12, contact extent 49 may pass through slots 40 without interfering with or engaging opposed walls 42. The contact extents 49 of contacts 14 are thereby in non-confined residence within slots 42. In the preferred construction contact extent 49 is formed to have a width $W_2$, which is just less than the width $W_1$ of slot 40. However, due to manufacturing tolerances, there may be slight interference between the walls 42 of slot 40 and contact extent 49 upon insertion of contacts 14 into housing 12. However, this minimal engagement does not impede or otherwise restrict the insertion of contacts 14 into housing 12. Thus, contact insertion may occur without interfering engagement between contact extent 49 and the side walls 42 of slots 40.

As shown in FIG. 2, in use connector 10 of the present invention requires that various contact patterns (i.e., position of contacts 14 within housing 12) be accommodated. In the present illustrative embodiment, contacts 14 are positioned such that at least two contact tails 48 are located in each slot 40. One contact tail 48 is positioned more forward against the closed end 43 of slot 40 while the other contact tail 48 is positioned at the intermediate slot portion 45 between closed end 43 and open end 41.

In order to captively retain the contact tails 48 within connector housing 12, the locator plate defined by bottom wall 30 may be deformed about contact extent 49 to captively retain the contact tails 48 therein. As described above, upon insertion of the contact tails 48 into the slots 40 of the locator plate defined by bottom wall 30, the contact tails will be in substantial non-engagement with the opposed slot side walls 42. The present invention contemplates deformation of the plastic material forming bottom wall 30 about contact tails 48. Such deformation would provide for plastic flow of the locator plate about tails 48 so that the plastic reforms thereabout positionally confining and securing the contact tails therein.

The present invention contemplates causing such plastic flow by use of ultrasonic equipment which serves to apply ultrasonic energy to the bottom wall 30 to cause the plastic contacted by the ultrasonic equipment to flow. Typical ultrasonic equipment would include an electrically powered ultrasonic horn which would apply appropriate vibratory energy against the bottom wall 30 sufficient to cause plastic flow. The ultrasonic equipment may also include a support positionable adjacent the connector so as to provide a support surface for the horn. The ultrasonic energy would be applied so as to melt the plastic adjacent the contact tails 48 so that the melted material flows thereabout. The horn remains stationary for an appropriate period of time which allows the flowed plastic to reform thereby securely supporting the contact tails 48 within the slots 40 of bottom wall 30. The horn and support may then be easily removed.

Figure 6:
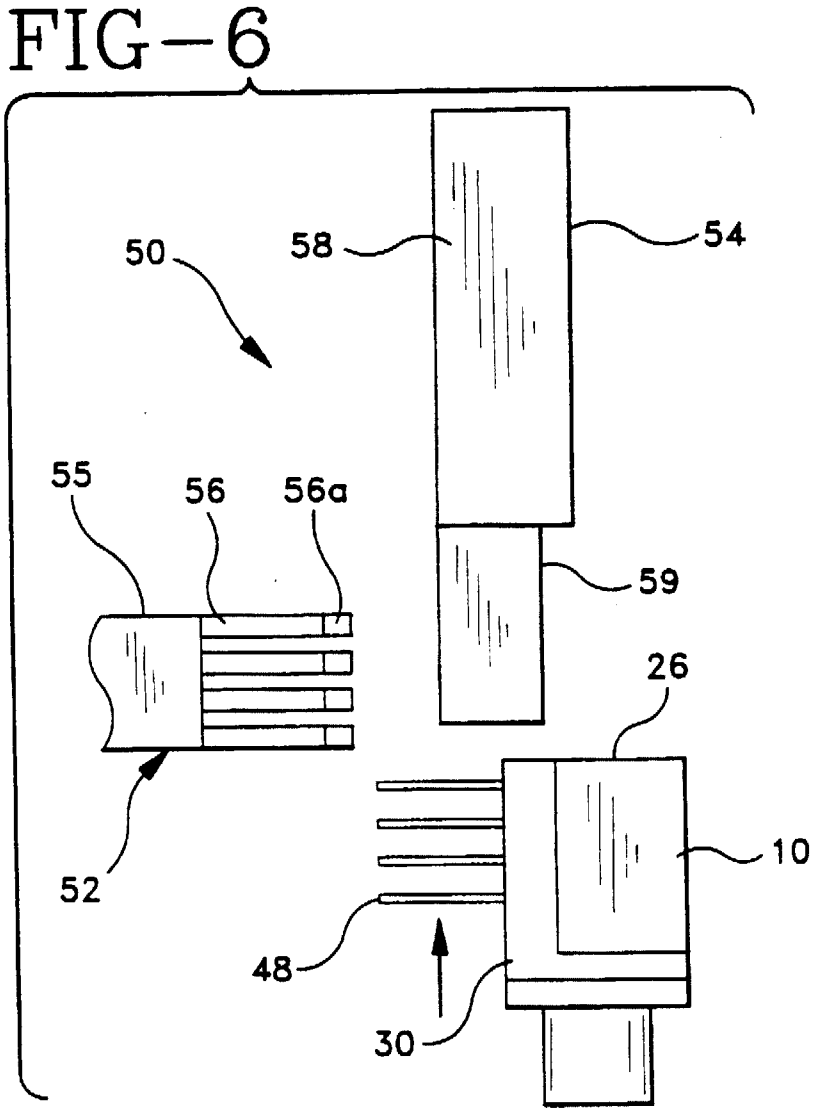
FIGS. 5 and 6 show in front plan and side elevational views, an ultrasonic swaging device used in combination with the connection of the present invention.
Figure 5:
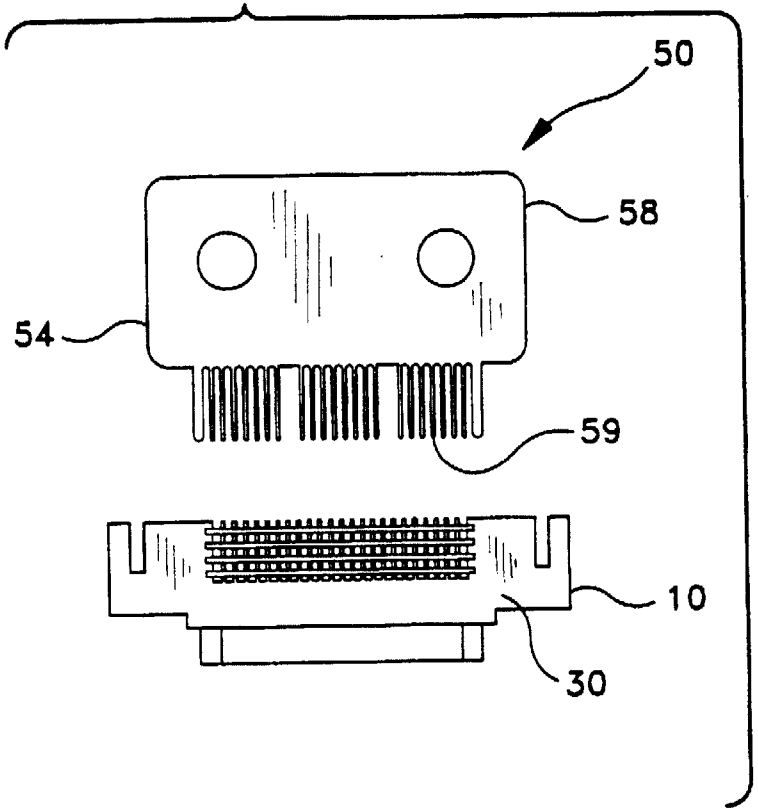
Figure 7:
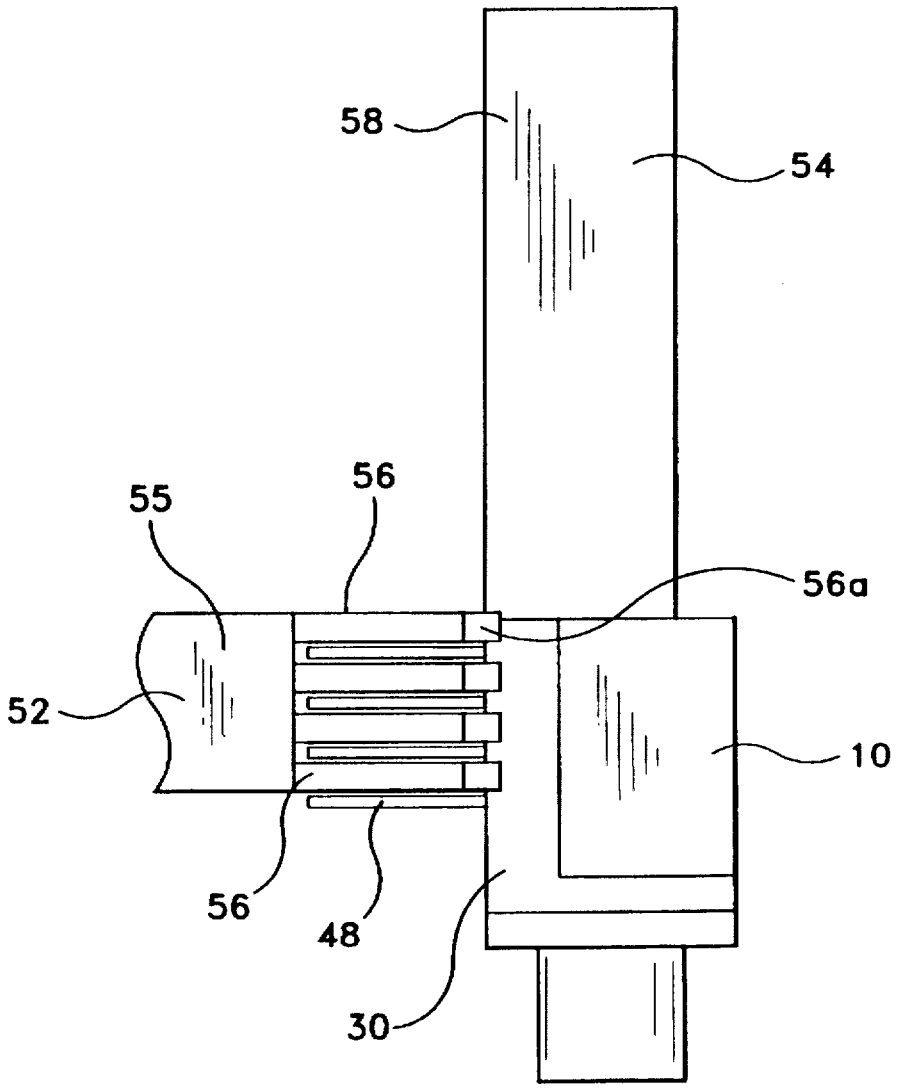
FIG. 7 shows the ultrasonic swaging device of FIGS. 5 and 6 used in combination with the connector of the present invention to swage the retention plate.

Ultrasonic swaging of the plastic material may be accomplished with conventional ultrasonic equipment which is well-known in the ultrasonic art. However, one type of equipment which has been found particularly suitable for use in combination with the connector of the present invention is shown and described with reference to FIGS. 5 through 7. Ultrasonic swaging assembly 50 includes an ultrasonic horn 52 and a support 54. Ultrasonic horn 52 includes a main body 55 which is connected to an appropriate electrical source so as to ultrasonically vibrate a plurality of metallic fingers 56 extending from body 55. Fingers 56 are constructed and arranged to be positionable between the rows of contact tails 48 of connector 10. The distal tips 56*a* of fingers 56 are placed in contact against bottom wall 30 as shown in FIG. 7. Support 54 is a metallic comb-like member having a main rectangular body 58 and a plurality of depending comb-like teeth 59 extending therefrom. Support 54 is insertable into cavity 26 of connector 10 so that the comb-like teeth 59 are interleaved between the contact tails 48. The support 54 is placed against the inside surface of bottom wall 30 so that the bottom wall is positioned between fingers 56 of horn 52 and the comb-like teeth 59 of support 54.

In conventional fashion, ultrasonic horn 52 is caused to vibrate thereby flowing the plastic of bottom wall 30 in contact with tips 56*a* of fingers 56 about contact tails 48. While the ultrasonic horn 52 is vibrating the plastic material 60 is allowed to reflow about contact extent 49 of tails 48. The horn 52 is stationary for an appropriate amount of time allowing the plastic to reform which positionally confines and secures the contact extents within slot 40. The contact tails 48 located at intermediate slot portion 45 include flowed plastic adjacent either opposed surface 48*a* and 48*b* so that the contact is prevented from moving in either direction. With respect to the contact tails 48 adjacent closed end 43 of slot 40, plastic flow is only necessary adjacent the contact surface 48*b* as the closed end 43 prevents movement of the contact tail thereagainst. Thus the present invention provides for the retention of contact tails 48 both at a location against the closed end 43 of slot 40 as well as at an intermediate slot position 45. The positioning of fingers 56 of horn 52 about either side of contact tails 48 which are positioned at intermediate slot portion 45 permits the retention of the tails 48 thereat.

Various changes to the foregoing described and shown structures would now be evident to those skilled in the art. Accordingly, the particularly disclosed scope of the invention is set forth in the following claims.

What is claimed is:

1. A method of retentively supporting an electrical contact in an electrical connector housing comprising the steps of:

providing a connector housing having a contact retention plate defining an elongate contact accommodation slot therein, said slot having an open end, an opposed closed end and an intermediate slot portion therebetween;

providing an electrical contact having a retention extent including opposed extent surfaces;

inserting said contact into said connector housing so that said retention extent is non-captively resident within said intermediate slot portion;

deforming said retention plate adjacent said intermediate slot portion about two opposed surfaces of said retention extent of said contact to captively confine said retention extent of said contact within said intermediate slot portion.

2. A method of claim 1 wherein said deforming step includes:

swaging said plate around said retention extent of said contact.

3. A method of claim 1 wherein said deforming step includes:

ultrasonically deforming said plate around said retention extent of said contact.

4. A method of claim 1 wherein said connector housing providing step includes:

providing said retention plate having a pair of elongate, substantially parallel side walls defining said slot.

5. A method of claim 4 wherein said inserting step includes:

inserting said retention extent of said contact into said slot with substantial non-engagement between said retention extent and said walls of said slot.

6. A method of claim 1 wherein said connector housing providing step includes:

providing said retention plate being formed of a plastic material capable of plastic flow upon application of a source of energy thereto.

7. A method of claim 6 wherein said deforming step includes:

applying an energy source to said plastic retention plate to cause flow of plastic material about said retention extent to captively retain said retention extent in said retention plate.

8. A method of claim 7 wherein said applying step further includes:

applying an ultrasonic force to said plastic retention plate.

9. A method of claim 1 wherein said inserting step includes inserting a plurality of contacts into said slot.

10. A method of claim 9 wherein said plural contact insertion step includes inserting said plurality of said contacts into said slot with at least one of said contact retention extents being resident within said intermediate slot portion.

11. A method of claim 1, wherein said slot has substantially uniform sidewalls prior to the deforming step.

12. A method of retentatively supporting an electrical contact in an electrical connector housing comprising the steps of:

providing a connector housing having a contact retention plate, the contact retention plate including a plurality of contact receiving slots formed therein, each contact receiving slot having an open end, an opposed closed end and substantially uniform parallel sidewalls defining an intermediate slot portion therebetween:

providing an electrical contact having a retention extent including two opposed extent surfaces;

inserting said contact into the contact retention plate so that said retention extent is non-captively resident within said intermediate slot portion; and deforming said retention plate at the two opposed contact extent surfaces thereby deforming the substantially uniform parallel sidewalls of the intermediate slot portion to captively retain the contact retention extent along the two opposed extent surfaces within said retention plate intermediate slot portion.

* * * * *